US006857826B2

(12) United States Patent
Seitz

(10) Patent No.: US 6,857,826 B2
(45) Date of Patent: Feb. 22, 2005

(54) INJECTOR FOR A POWDER COATING INSTALLATION

(75) Inventor: Kurt Seitz, Widnau (CH)

(73) Assignee: J. Wagner AG, Alstatten (CH)

( * ) Notice: Subject to any disclaimer, the term of this patent is extended or adjusted under 35 U.S.C. 154(b) by 16 days.

(21) Appl. No.: 10/395,832

(22) Filed: Mar. 24, 2003

(65) Prior Publication Data

US 2003/0180101 A1 Sep. 25, 2003

(30) Foreign Application Priority Data

Mar. 25, 2002 (DE) ..... 102 13 275

(51) Int. Cl.[7] ..... B65G 51/36

(52) U.S. Cl. ..... 406/34; 406/92; 406/152; 406/153

(58) Field of Search ..... 406/34, 36, 88, 406/92, 151, 152, 153

(56) References Cited

U.S. PATENT DOCUMENTS 5,035,360 A * 7/1991 Green et al. ..... 239/585
5,505,566 A * 4/1996 Gruber ..... 406/12
5,924,631 A 7/1999 Rodrigues et al.
6,071,348 A * 6/2000 Seitz et al. ..... 118/712
6,569,462 B1 * 5/2003 Cornelli et al. ..... 424/497

* cited by examiner

*Primary Examiner*—Joe Dillon, Jr.
(74) *Attorney, Agent, or Firm*—Faegre & Benson LLP

(57) ABSTRACT

An injector for a powder coating installation having an injector casing made of electrically non-conductive material, such as plastics. The interior surface and the exterior surface of the injector casing are coated with coatings of electrically conductive material, the coating of the exterior surface and the coating of the interior surface being electrically insulated from each other by interruptions. A means for tapping the friction charges is passed from the interior surface and out of the injector casing to a measuring instrument for measuring the charge current. The exterior surface of the injector casing is provided with a ground connection for establishing contact between the exterior surface and ground potential. In this manner the very small friction charge currents can be detected during operation of the injector without being affected by electromagnetic disturbances from outside.

11 Claims, 1 Drawing Sheet

INJECTOR FOR A POWDER COATING INSTALLATION

SUMMARY OF THE INVENTION

The instant invention relates to an injector for a powder coating installation comprising an injector casing made of electrically non-conductive material, in particular plastics.

A carrier gas, usually compressed air, and a colour powder are mixed inside injectors of the kind mentioned in order for the latter then to be conveyed by the carrier gas stream to a coating device, such as a spray gun, for spray coating a workpiece. Preferably the interior walls of the channel through which powder is transported are made of a non-conductive material, such as PTFE (polytetrafluoroethylene) in order to prevent powder from sticking to the interior wall, while on its way.

Friction of powder moving along the walls of the powder transportation channel generates friction charges in the powder. The charge current of these charges is a measure of both the quality and the density of the powder.

OBJECT OF THE INVENTION

It is an object of the invention to monitor the powder quality and powder density during operation while the powder is being moved inside the injector.

It is possible, with the injector according to the invention, to detect the charges generated by friction in the injector in the form of electrical currents, either continuously during operation or sporadically, to thereby determine the powder quality and powder density. As the inventors found, these electrical currents are very small (in the order of magnitude of $\mu$A [micro amperes]). Therefore, disturbances by electromagnetic waves in the surroundings of the injector must be kept away from the detection of the friction charge currents so as to avoid falsifications of the results of measurements made. That is accomplished by the invention in that the injector is shielded practically completely from any electromagnetic interference by virtue of having made practically all the outside surfaces of the injector and the components mounted on the same, like compressed air connections, ground connections, and the like either from electrically conductive material, such as metal, or from electrically conductive plastics or having them coated with such material and grounded. And, furthermore, the interior surfaces which likewise are electrically conductive are electrically insulated from the exterior surface by interruptions. Thus the very small friction charge currents generated during operation can be tapped from the interior surface without any disturbance and passed out of the injector to a measuring instrument for these currents. Accurate measuring thus is assured.

The invention will be described further, by way of example, with reference to the accompanying drawings.

DETAILED DESCRIPTION

Figure 1:
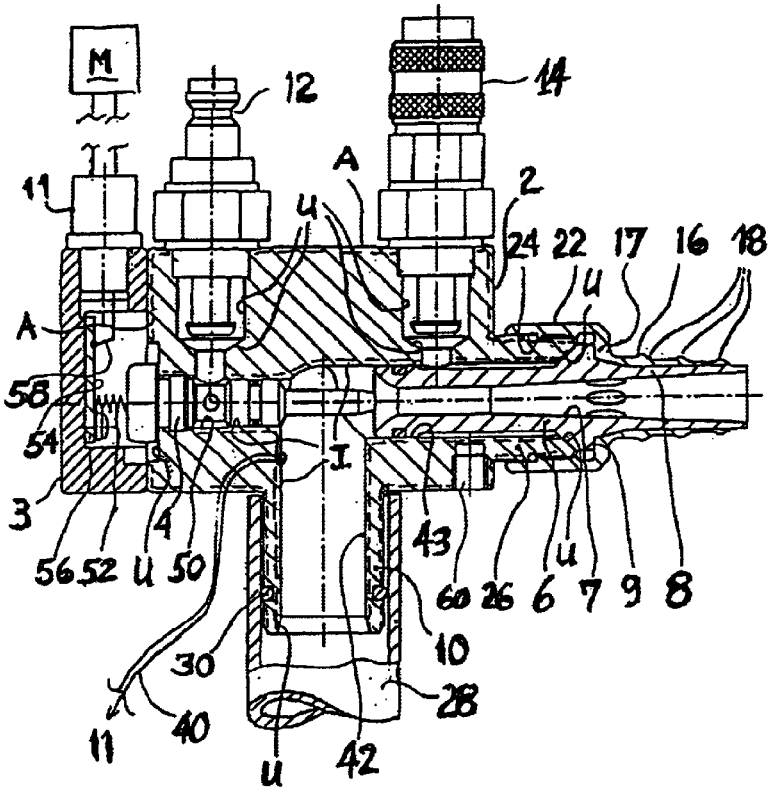
FIG. 1 is a longitudinal sectional elevation of an injector according to the invention.

The injector shown comprises an injector casing 2 made of an electrically non-conductive plastic material. It is covered by a metal cover 3 and houses a propelling nozzle 4 and a catching cone 6 in coaxial arrangement one behind the other. The catching cone 6 is made in one piece with a hose nozzle 8 of an electrically non-conductive plastic material, preferably PTFE (polytetrafluoroethylene) in order to prevent powder from sticking to the interior wall 7 of the hose nozzle 8. Moreover, PTFE contributes to generating a high friction charge current.

As usual, the injector casing includes a powder pipe connection 10 which communicates through a metal suction pipe 28 for powder with a powder reservoir (not shown). Likewise provided are a compressed air connection 12 for propelling nozzle air and a compressed air connection 14 for catching cone air. The connections 12 and 14 are made of metal. A sleeve 16 is drawn over the hose nozzle 8. The sleeve 16 carries the customary ribs 18 to receive and retain the end, facing the injector, of a conveyor hose which may be designed so as to be electrically conductive, such as by being made of an electrically conductive material.

At its end facing the injector, the sleeve 16 has an annular flange 17 merging in a coupling nut 22 which is threaded onto an external thread 24 of a connecting socket 26 for connection of the hose and which keeps the annular flange pressed against a radial shoulder 9 formed on the catching cone 6. The sleeve 16 and the coupling nut 22 are coated with a layer of electrically conductive material or are made of metal.

The metal cover 3 of the injector casing 2 is attached to the injector casing 2 by means of screws 13 and includes an electrical connection 11 for a measuring instrument M to detect friction charge currents as generated in the injector by the friction of powder particles along the interior walls of the transportation channel, such as the interior wall 7 of the catching cone 6. Furthermore, a ground connection 60 is provided at the cover 3 to connect the exterior surface of the injector casing 2 to ground (FIG. 2). Alternatively, such a ground connection 60' is provided at the injector casing 2 (FIG. 1).

As indicated by dashed lines, the exterior surfaces A and the interior surfaces I of the injector casing 2 each are provided with a coating of electrically conductive material, for instance, layers of metal. The coating of the exterior surface is separated from that of the interior surface by electrically insulating interruptions U. These interruptions U are located at locations of the injector casing which are readily accessible for machining, in particular by rotary tools, for monitoring, and also for cleaning or maintenance.

Figure 2:
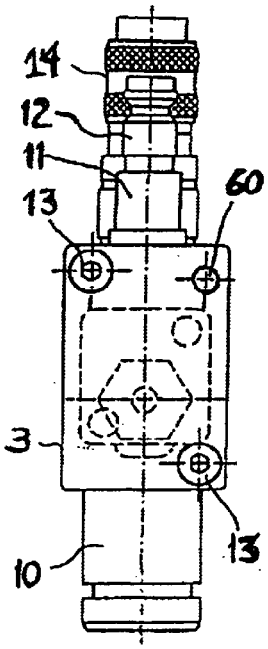
FIG. 2 is a left-hand view of FIG. 1.
Figure 3:
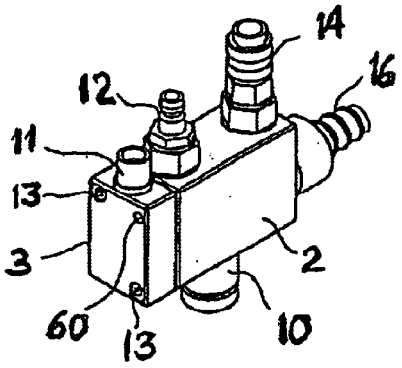
FIG. 3 is a perspective view of an injector as illustrated in FIGS. 1 and 2.

FIG. 1 illustrates two alternative solutions for tapping the electrical friction charges from the electrically conductive coating of the interior surface I of the injector casing 2. They will be described below one after the other.

According to a first alternative, an electrical lead wire 40 is passed out of the injector casing 2 from the interior wall 42 carrying an electrically conductive coating of the powder pipe connection 10. The electrically conductive layer on the interior wall 42 is in electrically conducting connection with the receiving bore or receiver 43, likewise carrying an electrically conductive layer, of the catching cone 6. Any friction charge generated within the catching cone 6 thus can flow out along this path through the wire 40 to the measuring instrument M and may be grounded to earth by ground connections 60 or 60', respectively. It is to be understood that wire 40 is connected to an insulated electrode in electrical connection or connector 11 in this alternative. It is further to be understood that, in this alternative, parts 52, 54, 56, and 58 are not needed and preferably are omitted.

According to a second alternative, friction charges are tapped via the metal propelling nozzle 4 which is threaded into a bore 50 designed to be electrically conductive inside the injector casing 2. Between the electrical connection 11 and the propelling nozzle 4, an electrical path is established through a spring 52, a metallized layer 54, an insulating plate 56 at the inner side of the cover 3, and a contact wire 58 leading from the metallized layer 54 to the connection 11. As with the first alternative, the electrical contact wire thus may pass the friction charge from the inside of the injector casing through the connection 11 to a measuring instrument M for measuring very small currents in the $\mu$-ampere range. It is to be understood that wire 40 is not needed in the second alternative.

The features disclosed in the specification above, in the claims and drawings may be significant for realizing the invention in its various modifications, both individually and in any combination. For example, and not by way of limitation, the electrically insulating interruptions (U) between the interior surface (I) and the exterior surface (A) are provided at locations inside the injector casing (2) which offer ready access for machining, monitoring, and maintenance.

What is claimed is:

1. An injector for a powder coating installation, comprising an injector casing (2) made of electrically non-conductive material, wherein the interior surface (I) and the exterior surface (A) of the injector casing (2) are designed to be electrically conductive;

the interior surface (I) and the exterior surface (A) are electrically insulated with respect to each other by interruptions (U);

a means for tapping the charges from the electrically conductive interior (I) is passed out of the injector casing (2) to a measuring instrument (M) for the charge current;

a ground connection (60,60') is provided to establish contact between the electrically conductive exterior surface of the injector casing (2) and ground potential and wherein the exterior surface (A) is operable and adapted to provide electromagnetic shielding of the interior conductive surface.

2. The injector as claimed in claim 1, wherein the interior surface (I) and the exterior surface (A) are coated with separate, mutually electrically insulated coatings of electrically conductive material.

3. The injector as claimed in claim 2, wherein the coatings are made of metal.

4. The injector as claimed in claim 1, wherein the tapping means is passed out of the injector casing (2) through a receiver (43) for a catching cone (6) via an electrical connection (11), the receiver (43) having an electrically conductive surface in conducting contact with the interior surface (I).

5. The injector as claimed in claim 1, wherein the tapping means is passed out of the injector casing via an electrical connection (11) through a propelling nozzle (4) of electrically conductive material, the propelling nozzle being seated in an electrically conductive receiver (50) in conducting contact with the interior surface (I).

6. The injector as claimed in claim 5, wherein an electrically conductive path between the propelling nozzle (4) and the electrical connection (11) comprises the receiver (50), a spring (52), an electrically conductive coating (54) of an insulating plate (56) connected to a cover (3) of the injector casing (2), and a contact wire (58) between the coating (54) and the insulating plate (56), and the electrical connection (11).

7. The injector as claimed in claim 1, wherein an electrical lead wire (40) is passed out of the injector casing (2) to guide the tapping means of the charges from the electrically conductive interior surface (I) out of the injector casing (2) to the measuring instrument.

8. The injector as claimed in claim 7, wherein a powder pipe connection (10) having an interior wall (42) designed at least partly to be electrically conducting, and a receiver (43) for a catching cone (6) are provided, the receiver (43) having an electrically conductive surface and being in electrically conducting contact with the electrically conductive interior wall (42) of the powder pipe connection (10), the lead wire (40) being electrically connected to the interior wall (42) of the powder pipe connection (10).

9. The injector as claimed in claim 1, wherein the electrically insulating interruptions (U) between the interior surface (I) and the exterior surface (A) are provided at locations inside the injector casing (2) which offer ready access for machining, monitoring, and maintenance.

10. The injector as claimed in claim 1, wherein all the components (11–14, 16, 60) of the injector which are disposed on the exterior surface are designed to be electrically conductive and are connected to the exterior surface.

11. The injector as claimed in claim 1 wherein the electrically non-conductive material comprises a plastic material.

* * * * *